US011805851B2

(12) United States Patent
Mason et al.

(10) Patent No.: US 11,805,851 B2
(45) Date of Patent: Nov. 7, 2023

(54) MID-SOLE, OR INSOLE, PARTICULARLY FOR SHOES

(71) Applicant: DIADORA SPORT S.R.L., Caerano di San Marco (IT)

(72) Inventors: Angelo Mason, Caerano di San Marco (IT); Enrico Polegato Moretti, Crocetta del Montello (IT)

(73) Assignee: DIADORA SPORT S.R.L., Caerano di San Marco (IT)

( * ) Notice: Subject to any disclaimer, the term of this patent is extended or adjusted under 35 U.S.C. 154(b) by 0 days.

(21) Appl. No.: 15/778,922

(22) PCT Filed: Nov. 23, 2016

(86) PCT No.: PCT/EP2016/078579
§ 371 (c)(1),
(2) Date: May 24, 2018

(87) PCT Pub. No.: WO2017/089414
PCT Pub. Date: Jun. 1, 2017

(65) Prior Publication Data

US 2018/0343967 A1 Dec. 6, 2018

(30) Foreign Application Priority Data

Nov. 24, 2015 (IT) ..... 102015000075744

(51) Int. Cl.
*A43B 7/1485* (2022.01)
*A43B 5/02* (2006.01)
(Continued)

(52) U.S. Cl.
CPC ..... *A43B 7/1485* (2013.01); *A43B 5/02* (2013.01); *A43B 5/06* (2013.01); *A43B 5/10* (2013.01)

(58) Field of Classification Search
CPC ..... A43B 5/06; A43B 13/181; A43B 7/1485; A43B 1/0018; A43B 17/03; A43B 17/08; A43B 17/14
(Continued)

(56) References Cited

U.S. PATENT DOCUMENTS 4,267,648 A 5/1981 Weisz
4,345,387 A * 8/1982 Daswick ..... A43B 7/146 36/29
(Continued)

FOREIGN PATENT DOCUMENTS

CN 103704936 A 4/2014
EP 3039979 A1 7/2016
(Continued)

OTHER PUBLICATIONS

International Search Report dated Feb. 2, 2017 re: Application No. PCT/EP2016/078579, pp. 1-3, citing: WO 2009/136685 A1 and US 4 521 979 A.
(Continued)

*Primary Examiner* — Patrick J. Lynch
(74) *Attorney, Agent, or Firm* — CANTOR COLBURN LLP

(57) ABSTRACT

A mid-sole, or insole, particularly for shoes, is constituted by a body which has an upper surface which has a plantar-like perimetric shape.
From the lower surface of the body a first plurality and a second plurality of elastically compressible protrusions protrude downward, each one having an axial cavity.
During walking or running, the protrusions adapt rapidly to movements and to the shape.

14 Claims, 6 Drawing Sheets

(51) Int. Cl.
*A43B 5/06* (2022.01)
*A43B 5/10* (2006.01)

(58) Field of Classification Search
USPC ..... 36/28, 29
See application file for complete search history.

(56) References Cited

U.S. PATENT DOCUMENTS 4,521,979 A 6/1985 Blaser
5,086,574 A * 2/1992 Bacchiocchi ..... A43B 21/26 36/28
6,434,859 B1 * 8/2002 Kim ..... A43B 7/142 36/43
6,751,890 B1 * 6/2004 Tsai ..... A43B 7/081 36/29
7,383,648 B1 * 6/2008 Litchfield ..... A43B 13/203 36/29
7,712,229 B2 * 5/2010 Yang ..... A43B 1/0045 36/29
7,721,466 B2 * 5/2010 Guo ..... A43B 13/36 36/15
D738,078 S * 9/2015 Raysse ..... A43B 7/142 D2/951
9,155,355 B2 * 10/2015 Diepenbrock ..... A43B 17/023
2004/0134098 A1 * 7/2004 Beck ..... A43B 17/08 36/44
2005/0193589 A1 * 9/2005 Bann ..... A43B 13/181 36/28
2006/0070170 A1 * 4/2006 Copeland ..... A63B 71/10 2/412
2009/0293311 A1 12/2009 Sun
2010/0037482 A1 * 2/2010 Litchfield ..... A43B 13/203 36/29
2012/0180336 A1 * 7/2012 Sullivan ..... A43B 7/144 36/31
2014/0331517 A1 * 11/2014 Seo ..... A43B 7/32 36/28
2014/0366399 A1 * 12/2014 Wakeland ..... A43B 17/08 36/44
2016/0345666 A1 * 12/2016 Kohatsu ..... A43B 13/181

FOREIGN PATENT DOCUMENTS

JP H05503451 A 6/1993
JP H11151101 A 6/1999
JP 2009537185 A 10/2009
KR 20090004464 A 1/2009
WO 9111928 A1 8/1991
WO 2009136685 A1 11/2009
WO WO-2009136685 A1 * 11/2009 ..... A43B 1/0009
WO 2015097015 A1 7/2015

OTHER PUBLICATIONS

Written Opinion dated Feb. 2, 2017 re: Application No. PCT/EP2016/078579, pp. 1-4, citing: WO 2009/136685 A1 and US 4 521 979 A.
KR Office Action dated Oct. 6, 2020 re: Application No. 2018-526811, pp. 1-13, citing: JP H05-503451 A, WO 2015/097015 A1, JP H11-151101 A, U.S. Appl. No. 04/521,979 A, WO 2009/136685 A1, WO 91/11928A1, JP 2009-537185 A, US 2009/0293311 A1, JP H07-018609 U and JP H02-009105 U.
CN Office Action dated May 6, 2021, re: Application No. 2016800686352, pp. 1-2.
European Office Action for European Application No. 16802018.8, dated Mar. 13, 2023, 5 pages.

* cited by examiner

MID-SOLE, OR INSOLE, PARTICULARLY FOR SHOES

TECHNICAL FIELD

The present disclosure relates to a mid-sole, or insole, particularly for shoes, such as for example sports shoes for running, tennis and football, and leisure shoes.

BACKGROUND

Nowadays it is known to provide a mid-sole for shoes that usually has a contained thickness and is made with elastically flexible material, both in order to conform anatomically to the foot as a function of the configurations it assumes during walking or running, and also in order to act as a shock absorber.

The mid-sole, in fact, must be capable of adequately decreasing the excessive load in the impact area of the foot with respect to the ground, and elastically return part of the energy received during the normal heel-toe stride, while simultaneously decreasing muscular stress and loads to the detriment of the muscular-skeletal apparatus.

Nowadays, in order to meet such needs, mid-soles are used whose principal functions are, therefore, the absorption of impact during the normal heel-toe stride, elastic yield for transferring loads from the heel to the toes, and flexibility for the thrust phase.

It is therefore known to provide a mid-sole for shoes which is made of expanded polyurethane (EP) or of ethylene vinyl acetate (EVA), which constitute up about 90% of the mid-sole and are characterized by a single rigidity level over the entire length of the mid-sole, from the heel to the toe. A drawback that is found in the cited known art consists in that the mid-sole made of EVA or of EP adapts slowly to the shape of the sole of the foot of the user, and therefore it is not capable of ensuring an adequate anatomical adaptation during use, making the shoe rather uncomfortable.

This drawback is felt more for users who suffer from overpronation or from excessive supination.

Pronation is a normal part of running that consists of the natural tendency of the foot to rotate inward during walking or running, in order to absorb shocks; some people have an excessive rotation (overpronation), which continues after the impact of the foot on the ground, or an insufficient rotation of the foot (excessive supination), both of which influence the manner of running and can increase the risk of injury and generate tendinitis both in the foot and in the knees, plantar fasciitis and other muscular inflammations.

In order to overcome these drawbacks, it is known to insert rigid supporting elements, for example in the form of vertical walls of greater or lesser thickness, in the medial wall of the mid-sole, at the plantar arch.

Such rigid elements are uncomfortable and inconvenient because they do not adapt to the shape of the sole of the foot, since they are not three-dimensionally and anatomically shaped to fit the foot.

Conventional mid-soles are often reinforced in the waist area by way of the use of added materials the function of which is to lighten and cushion the mid-sole; the use is known of pads, arranged in the heel region, which contain air or gel or similar materials, which increase impact absorption and are adapted to deform, elastically absorbing the energy of impact with the ground.

A drawback of such conventional solutions consists of a loss of impact absorption, with consequent loss of elasticity, owing to the fact that, as a consequence of repeated compressions during use, over time the mid-sole loses the shock-absorption properties and the elastic return of the thrust phase; this can be due both to the characteristics of the principal material with which it is made, and to the use of pads that can easily deflate and break if subjected to the repeated compressions that arise during sporting activity.

SUMMARY

The aim of the present disclosure is to provide a mid-sole, or insole, particularly for shoes, that is capable of adapting rapidly to movements and to the shape of the foot of the user and which has good characteristics for cushioning and thrust.

Within this aim, the present disclosure provides a mid-sole, or insole, that ensures that the cushioning and thrust capacities are maintained over time.

The disclosure also provides a mid-sole, or insole, that ensures that an adequate level of anatomical adaptation is reached also for persons with problems of overpronation or of excessive supination.

The disclosure further provides a mid-sole, or insole, that is structurally simple and low cost and can be made with the usual conventional plants.

These advantages which will become better apparent hereinafter are achieved by providing a mid-sole, or insole, particularly for shoes, which is constituted by a body having an upper surface having a plantar-like perimetric shape, characterized in that from the lower surface of said body a first plurality and a second plurality of elastically compressible protrusions protrude downward, each one having an axial cavity.

BRIEF DESCRIPTION OF THE DRAWINGS

Further characteristics and advantages of the disclosure will become better apparent from the detailed description of a particular, but not exclusive, embodiment of the mid-sole, or insole, according to the disclosure, which is illustrated by way of non-limiting example in the accompanying drawings wherein.

DETAILED DESCRIPTION OF THE DRAWINGS

Figure 1:
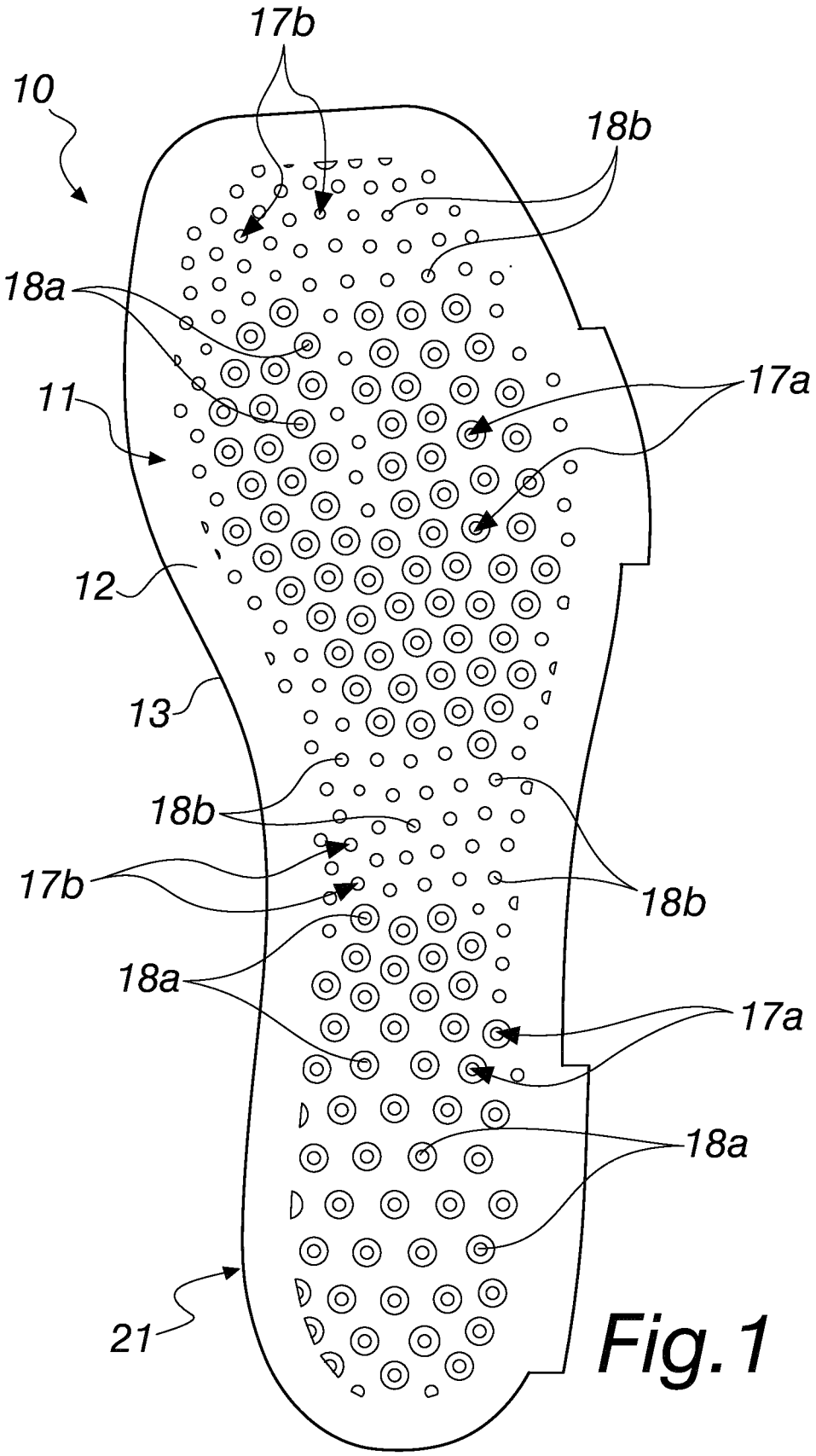
FIG. 1 is a view from above of a mid-sole or insole according to the disclosure.
Figure 2:
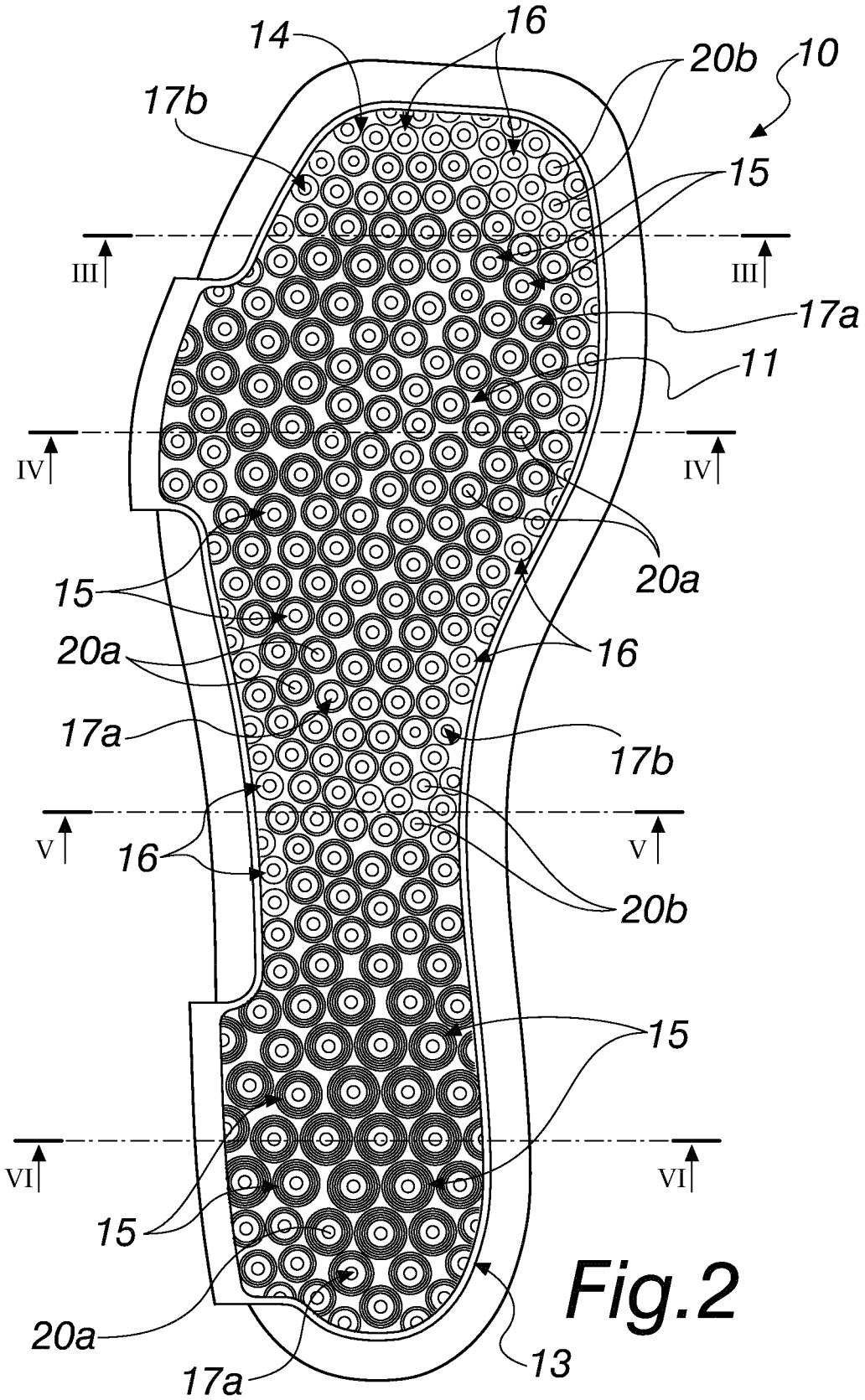
FIG. 2 is a view from below of the mid-sole or insole of FIG. 1.
Figure 3:
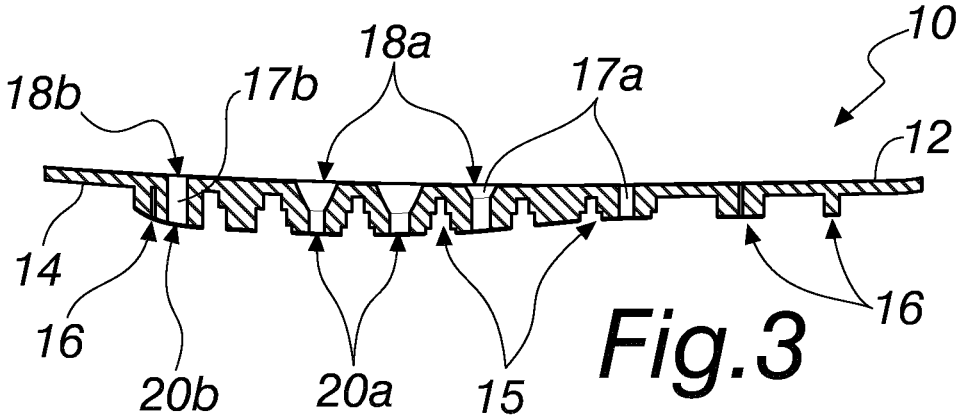
FIG. 3 is a cross-sectional view taken along the line of FIG. 2.
Figure 4:
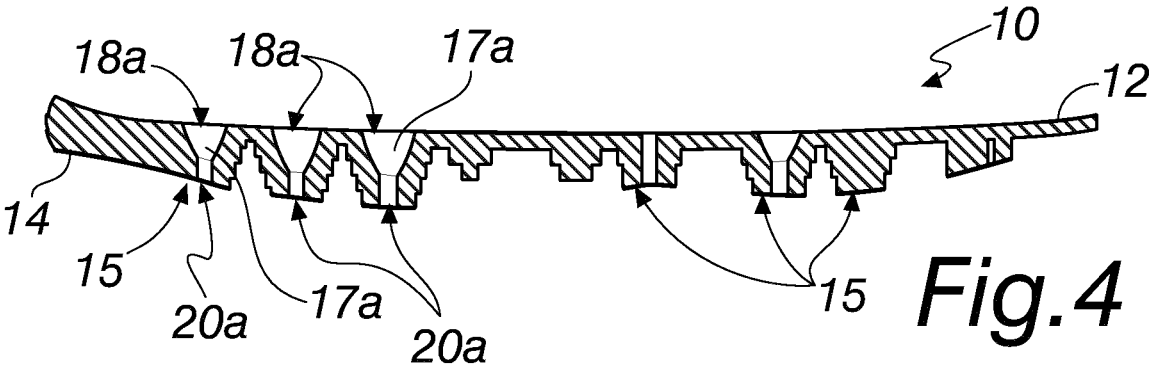
FIG. 4 is a cross-sectional view taken along the line IV-IV of FIG. 2.
Figure 5:
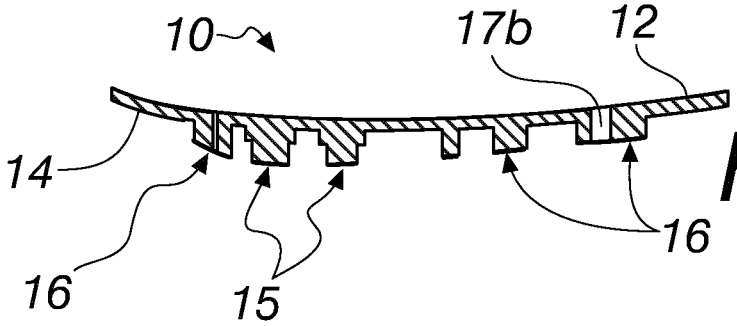
FIG. 5 is a cross-sectional view taken along the line V-V of FIG. 2.
Figure 6:
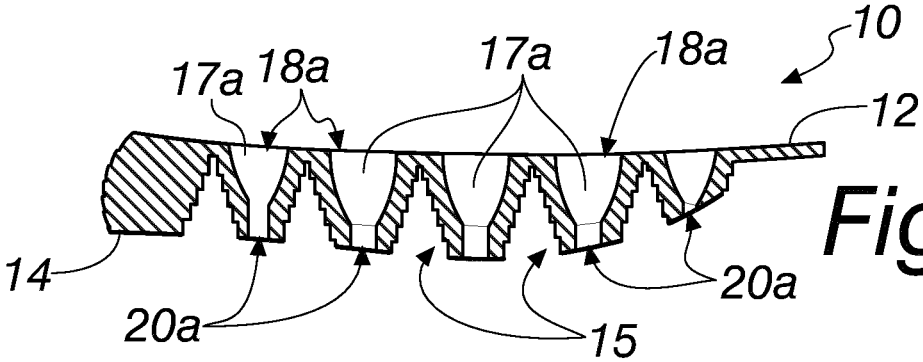
FIG. 6 is a cross-sectional view taken along the line VI-VI of FIG. 2.
Figure 7:
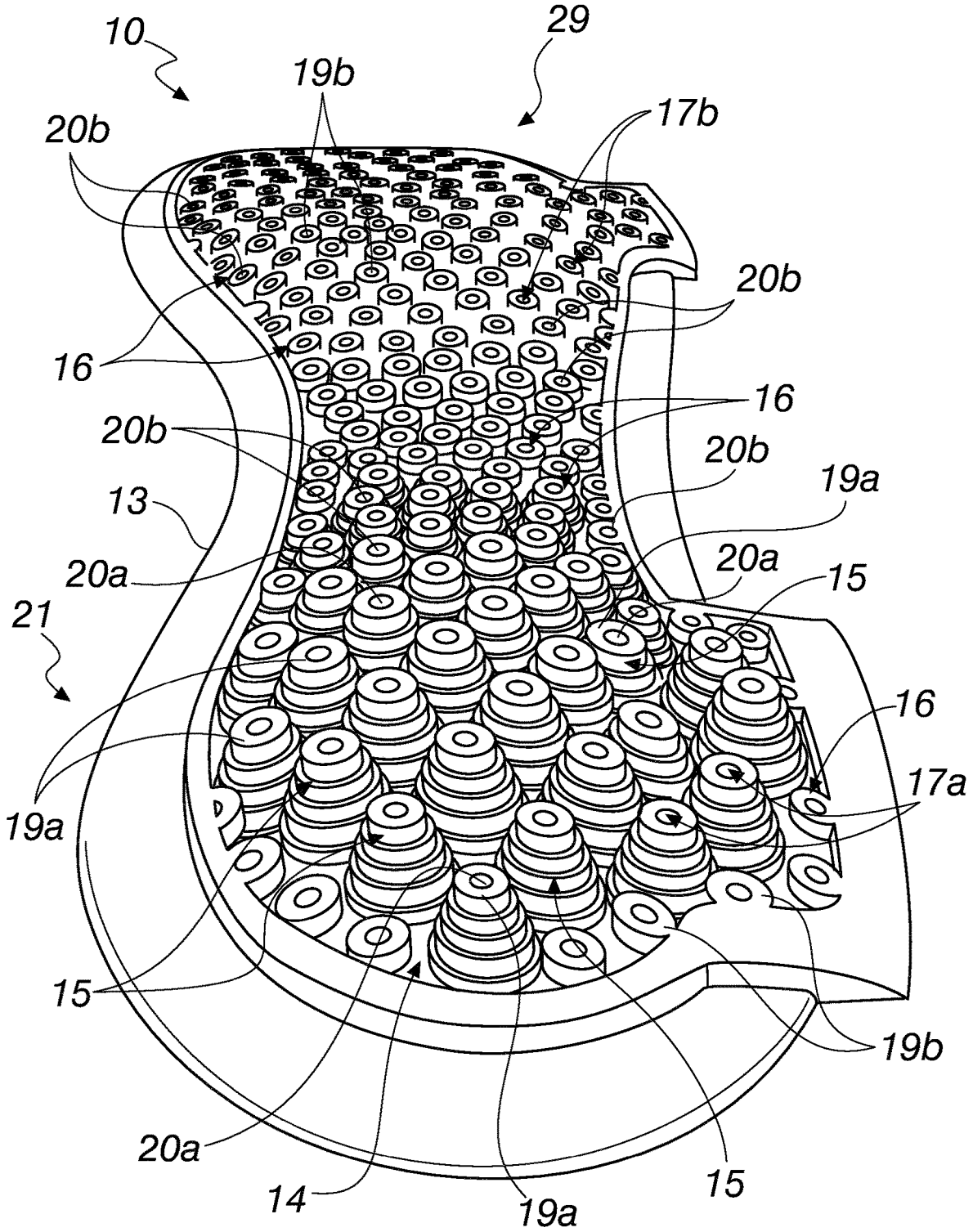
FIG. 7 is a perspective view from the heel of the lower surface of the mid-sole or insole.

In the embodiments illustrated below, individual characteristics shown in relation to specific examples may in reality be interchanged with other, different characteristics, existing in other embodiments.

With reference to FIGS. 1-12, the reference numeral 10 generally designates a mid-sole, particularly for shoes, which is constituted by a body 11, contoured to contain the sole of the foot, so as to thus define an upper surface 12 that has a plantar-like perimetric shape surrounded by a first outer perimetric edge 13.

The thickness of the body 11 is substantially constant.

The mid-sole 10 is provided in a single piece or in multiple elements; if produced in a single piece, it is provided using a material that has elastic characteristics, in order to facilitate its return to its original shape during the use of the shoe, and which has a density preferably comprised between (0.15-1.20) g/cm$^3$ and a hardness preferably comprised between (15-60) Shore A, such as for example SBS (styrene-butadiene-styrene) rubber, N.R. rubber (natural rubber), rubber and EVA (ethylene vinyl acetate), TPU (thermoplastic polyurethane) and two-component (polyol-isocyanate) expanded polyurethane EP.

First pluralities of protrusions 15 and second pluralities of protrusions 16 protrude downward from the lower surface 14 of the body 11 of the mid-sole 10.

The first pluralities of protrusions 15 and the second pluralities of protrusions 16 affect the entire lower surface 14 of the body 11 and have a substantially frustum-like or pyramid-like and/or cylindrical shape.

Preferably the first pluralities of protrusions 15 have a frustum shape, while the second pluralities of protrusions 16 have a cylindrical shape.

The first and the second pluralities of protrusions 15, 16 are elastically compressible and each one has, respectively, a first axial cavity 17*a* and a second axial cavity 17*b*.

Respectively first holes 18*a*, 18*b* are present at the upper surface 12 of the mid-sole 10, at each one of the first pluralities of protrusions 15 and of the second pluralities of protrusions 16.

Each one of the first holes 18*a* of the first pluralities of protrusions 15 is connected to the respective first axial cavity 17*a* which ends, at the first apex 19*a* of each one of the first pluralities of protrusions 15, in second holes 20*a*.

Each one of the first holes 18*b* of the second pluralities of protrusions 16 is connected to the respective second axial cavity 17*b* which ends, at the second apex 19*b* of each one of the second pluralities of protrusions 16, in second holes 20*b*.

The plurality of first holes 18*a*, 18*b* and of second holes 20*a*, 20*b* has a desired diameter; advantageously the first holes 18*a* have a larger diameter than the diameter of the second holes 20*a*.

Each one of the first holes 18*a*, 18*b* has a variable diameter, preferably comprised between 1 and 10 mm as a function of the desired area of the mid-sole 10 in which the corresponding first protrusion 15 or second protrusion 16 is positioned; advantageously the first protrusions 15, which have the first hole 18*a* of larger diameter and a greater protrusion with respect to the lower surface 14, are arranged at the central area of the heel 21 in the central area of the forefoot 29; advantageously therefore the first and the second apices 19*a*, 19*b* of the first and second protrusions 15, 16 lie on ideal, anatomically-contoured curved surfaces.

However, each one of the second holes 20*a*, 20*b* has substantially the same diameter, preferably of approximately 2 mm.

On the lateral surface of each one of the first pluralities of protrusions 15 there is a series of concentric annular grooves that increase in diameter in the direction of the upper surface 12 of the mid-sole 10 and which give the first pluralities of protrusions 15 the shape of a stepped pyramid.

This enables the first apices 19*a* of the first pluralities of protrusions 15 to collapse into the first axial cavity 17*a* thus cushioning the impact, while the presence of the concentric annular grooves of increasing diameter makes it possible to provide the elastic yield by returning the propulsive energy until the first pluralities of protrusions 15 are returned to the original shape structure, performing another cycle of impact/cushioning and elastic yield/propulsion.

The presence of the first and second axial cavities 17*a*, 17*b* contributes to lightening the mid-sole 10.

The arrangement on the desired area of the lower surface 14 of the mid-sole 10 and the size of each one of the first and second pluralities of protrusions 15, 16 and their concentration are defined as a function of the desired cushioning function, elastic yield and propulsion correlated with the anatomical shape structure of the foot of the user and of the type of activity performed by the user.

Advantageously each one of the second pluralities of protrusions 16 is constituted by a single cylindrical element.

In a first and a second variation of embodiment, each one of the first and second pluralities of protrusions 15, 16 is open at one end and closed at the other end.

Figure 8:
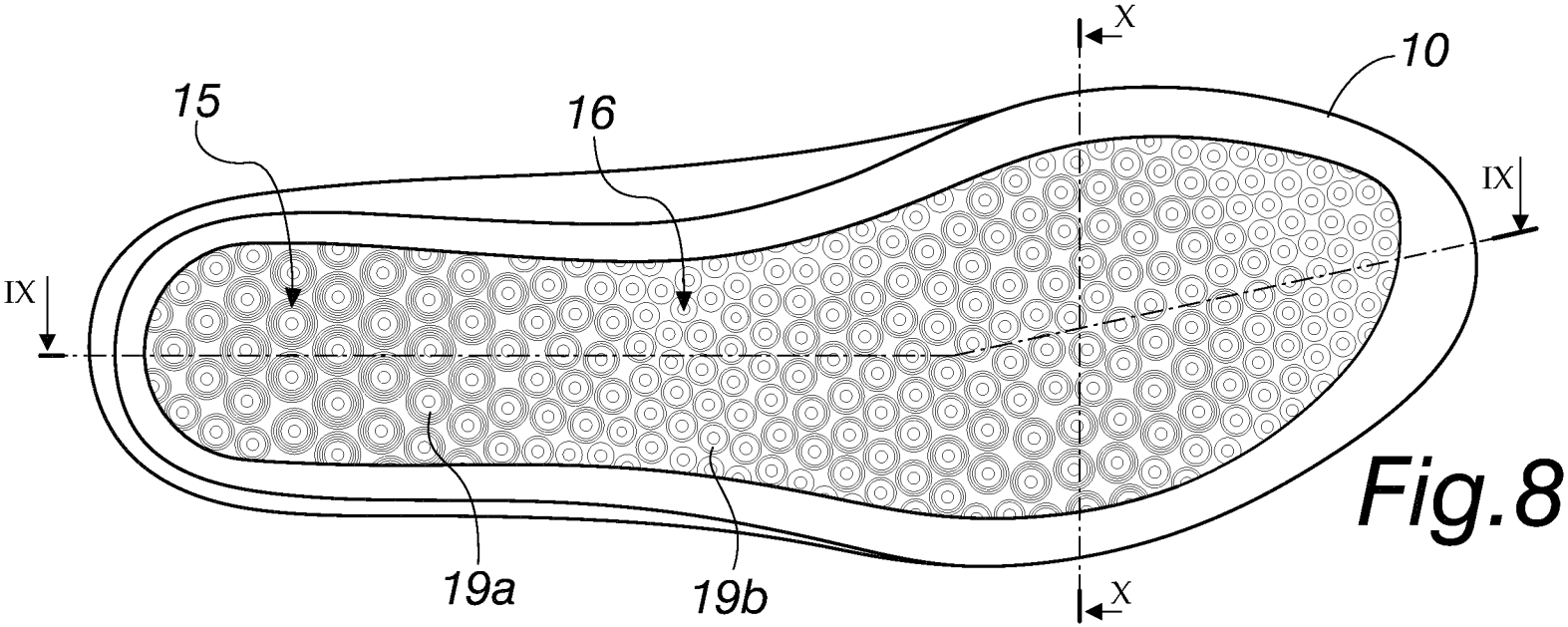
FIG. 8 is a view from below of a first variation.
Figure 9:
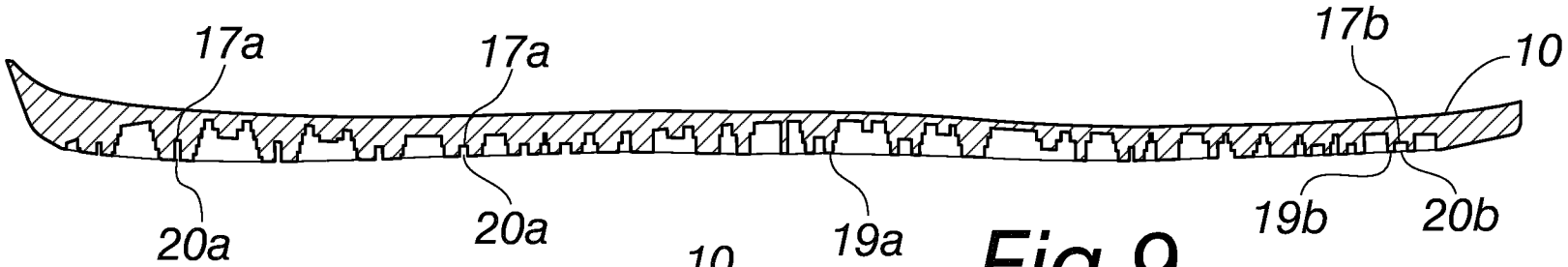
FIG. 9 is a cross-sectional view taken along the line IX-IX of FIG. 8.
Figure 10:
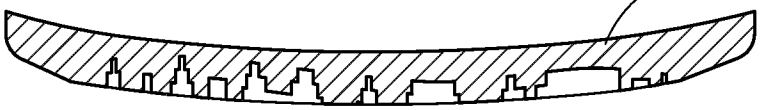
FIG. 10 is a cross-sectional view taken along the line X-X of FIG. 8.

In particular, in a first variation shown in FIGS. 8 to 10, each one of the first holes 20*a* of the first pluralities of protrusions is connected to the respective first axial cavity or first axial blind cavity 17*a*.

Furthermore, each one of the second holes 20*b* of the second pluralities of protrusions 16 is connected to the respective first axial blind cavity 17*b*.

The thickness of the body 11 varies as a function of the position with respect to the foot, assuming an anatomical configuration.

The plurality of first and second apices 19*a*, 19*b*, all lie on a substantially flat surface with no anatomically shaped regions.

Figure 11:
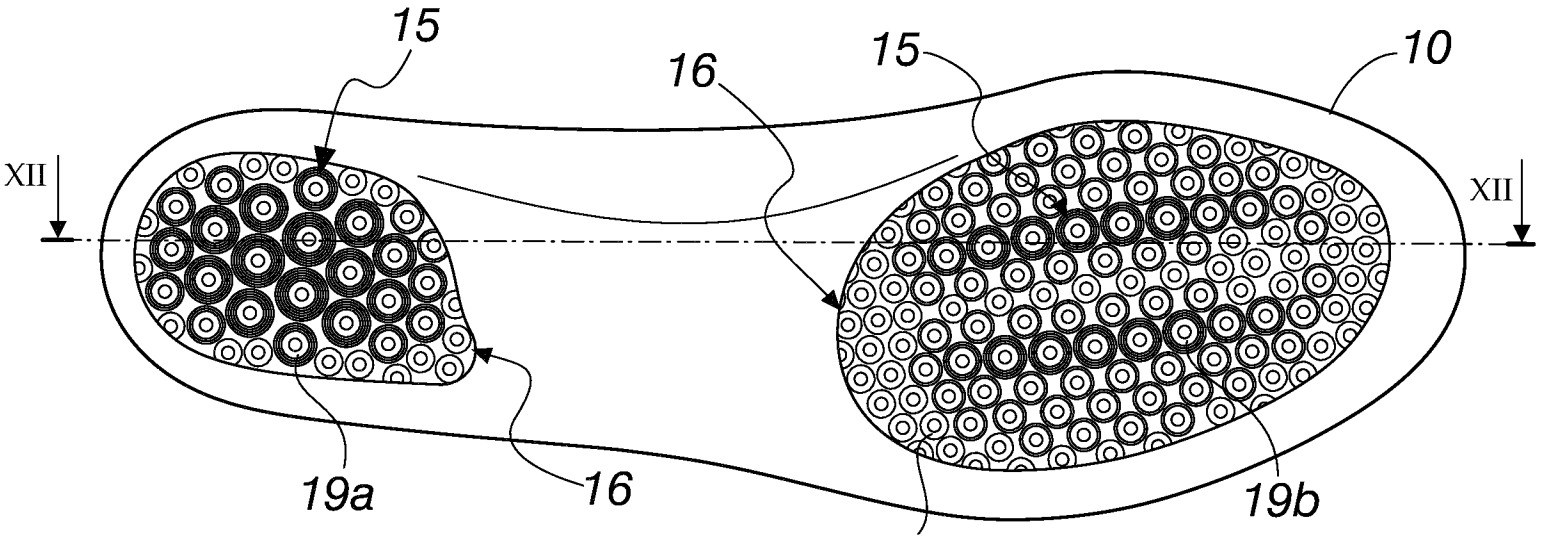
FIG. 11 is a view from below of a second variation.
Figure 12:
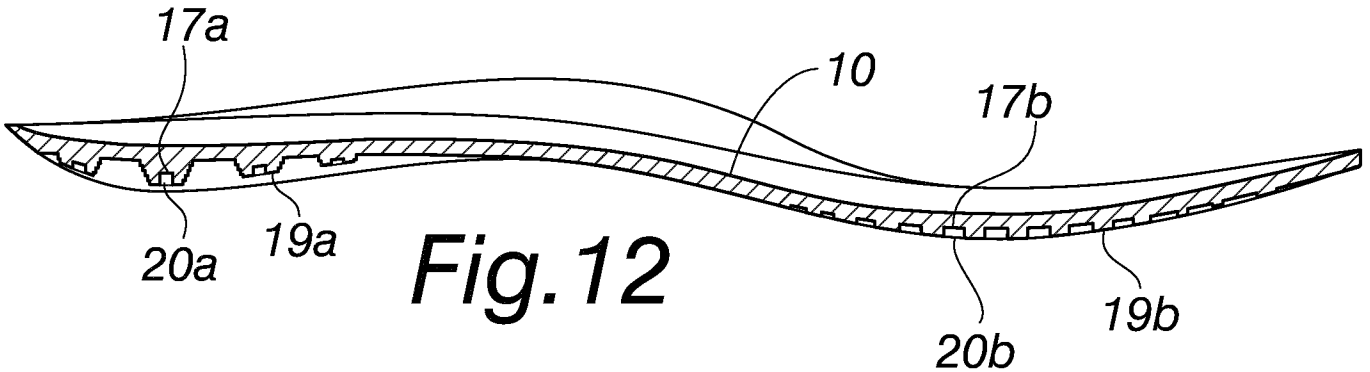
FIG. 12 is a cross-sectional view taken along the line XII-XII of FIG. 11.

In a second variation shown in FIGS. 11 and 12, the first plurality of protrusions 15 and the second plurality of protrusions 16 partially affect the lower surface 14 of the body 11, and specifically they are restricted to the heel region 21 and to the forefoot region 29.

Furthermore, also in this embodiment each one of the first and second pluralities of protrusions 15, 16 is open at one end and closed at the other end.

In particular, each one of the first holes 20*a* is connected to the respective first axial blind cavity 17*a*.

In this case, the thickness of the body 11 is substantially constant.

The apices 19*a*, 19*b* of the protrusions 15, 16 lie on ideal, anatomically-contoured curved surfaces.

Each one of the second holes 20*b* of the second pluralities of protrusions 16 is connected to the respective second axial cavity 17*b*.

Thus it has been found that the disclosure fully achieves the intended aim and objects, a mid-sole, or insole, having being obtained that is capable of adapting rapidly to the movements and to the shape structure of the foot of the user, while at the same time having good cushioning and thrust characteristics.

It has further been found that the mid-sole according to the disclosure ensures that the cushioning and thrust capacities are maintained over time and that an adequate level of anatomical adaptation is achieved even for users with problems of overpronation or of excessive supination.

The disclosure thus conceived is susceptible of numerous modifications and variations; thus, for example, the cavities of the protrusions can be open only in an upper region or in a lower region and closed at the opposite end, according to the implementation parameters.

The materials used as well as the dimensions of the individual components of the disclosure may be more relevant according to specific requirements.

The characteristics indicated above as advantageous, convenient or the like, may also be missing or be substituted by equivalent characteristics.

The disclosures in Italian Patent Application No. 102015000075744 (UB2015A005843) from which this application claims priority are incorporated herein by reference.

The invention claimed is:

1. A mid-sole, or insole for shoes, comprising: a body having an upper surface configured to be oriented towards the sole of a foot and a lower surface configured to be oriented away from the sole of the foot, said upper surface having a plantar perimetric shape, wherein from said lower surface of said body a first plurality and a second plurality of protrusions protrude downward wherein the protrusions protrude at varying distances such that the mid-sole has a continually varying thickness and each one of the first and second plurality of protrusions has an axial cavity, wherein first holes are disposed at said upper surface of said body, at each protrusion of said first and second plurality of protrusions, wherein said first plurality of protrusions have a first group of first holes disposed at a heel region and a forefoot region, and a second group of first holes disposed at areas other than said heel region and said forefoot region, wherein each first hole of said first group having a first diameter and each first hole of said second group having a second diameter smaller than said first diameter, wherein said first plurality of protrusions have first apices and said second plurality of protrusions have second apices, wherein said first plurality of protrusions are frustum-shaped and said second plurality of protrusions are each a single cylinder, each of said first and second apices of said first and second plurality of protrusions having a curved surface, such that the curved surfaces of said first and second apices of said first and second plurality of protrusions conform along a curved plane, wherein the body is anatomically varied.

2. The mid-sole according to claim 1, wherein said mid-sole is provided in a single piece or in multiple elements, said mid-sole having elastic characteristics adapted to facilitate return of said mid-sole to an original shape during use and having a density comprised between 0.15-1.20 g/cm$^3$ and a hardness comprised between 15-60 Shore A.

3. The mid-sole according to claim 1, wherein each one of said first and second plurality of protrusions has, respectively, a first axial cavity and a second axial cavity both thereof affect the entire height or thickness of said mid-sole.

4. The mid-sole according to claim 1, wherein said first holes of said first plurality of protrusions are connected to a first axial through cavity, which ends, at the first apex of each protrusion of said first plurality of protrusions, in a second hole.

5. The mid-sole according to claim 4, wherein each one of said first holes of said second plurality of protrusions is connected to said first axial through cavity, which ends, at the second apex of each protrusion of said second plurality of protrusions, in a second hole.

6. The mid-sole according to claim 5, wherein the apices of the protrusions of said first and second plurality of protrusions lie on anatomically-contoured curved surfaces.

7. The mid-sole according to claim 5, wherein said apices of the protrusions of said first and second plurality of protrusions all lie on a flat surface.

8. The mid-sole according to claim 4, wherein the first diameter of said first holes is larger than a diameter of said second holes.

9. The mid-sole according to claim 4, wherein the diameter of each one of said first holes is comprised between 1 mm and 10 mm and is located in a region of said mid-sole in which the corresponding first plurality of protrusions or second plurality of protrusions is arranged, each one of said second holes having a diameter of 2 mm.

10. The mid-sole according to claim 1, wherein on a lateral surface of each one of said first plurality of protrusions there is a series of concentric annular grooves that increase in diameter in a direction of said upper surface of said mid-sole and which give said first plurality of protrusions the shape of a stepped pyramid.

11. The mid-sole according to claim 1, wherein each one of said first and second plurality of protrusions is open at one end and closed at another end.

12. The mid-sole according to claim 1, wherein the mid-sole is provided by using a material that has elastic characteristics and has a density comprised between 0.15-1.20 g/cm$^3$ and a hardness comprised between 15-60 Shore A.

13. A mid-sole for shoes, comprising: a body having an upper surface configured to be oriented towards the sole of a foot and a lower surface configured to be oriented away from the sole of the foot, said upper surface having a plantar perimetric shape, wherein from said lower surface of said body a first plurality and a second plurality of protrusions protrude downward wherein the protrusions protrude at varying distances such that the mid-sole has a continually varying thickness and each one of the first and second plurality of protrusions has an axial cavity, wherein first holes are disposed at said upper surface of said body, at each protrusion of said first and second plurality of protrusions, wherein said first plurality of protrusions have a first group of first holes disposed at a heel region and a forefoot region, and a second group of first holes disposed at areas other than said heel region and said forefoot region, wherein each first hole of said first group having a first diameter and each first hole of said second group having a second diameter smaller than said first diameter, wherein said first plurality of protrusions have first apices and said second plurality of protrusions have second apices, wherein said first plurality of protrusions are frustum-shaped and said second plurality of protrusions are each a single cylinder, each of said first and second apices of said first and second plurality of protrusions having a curved surface, such that the curved surfaces of said first and second apices of said first and second plurality of protrusions conform along a curved plane, wherein the body is anatomically varied.

14. A mid-sole for shoes, or insole for shoes, comprising: a body having an upper surface configured to be oriented towards the sole of a foot and a lower surface configured to be oriented away from the sole of the foot, said upper surface having a plantar perimetric shape, wherein from said lower surface of said body a first plurality and a second plurality of protrusions protrude downward wherein the protrusions protrude at varying distances such that the mid-sole has a continually varying thickness and each one of the first and second plurality of protrusions has an axial cavity, wherein first holes are disposed at said upper surface of said body, at each protrusion of said first and second plurality of protrusions, wherein said first plurality of protrusions have a first group of first holes disposed at a heel region and a forefoot region, and a second group of first holes disposed at areas other than said heel region and said forefoot region, wherein each first hole of said first group having a first diameter and each first hole of said second group having a second diameter smaller than said first diameter, wherein said first plurality of protrusions have first apices and said second plurality of protrusions have second apices, each of said first and second apices of said first and second plurality of protrusions having a curved surface, such that the curved surfaces of said first and second apices of said first and second plurality of protrusions conform along a curved plane, wherein the body is anatomically varied, wherein said first plurality of protrusions are frustum-shaped and said second plurality of protrusions are each a single cylinder.

* * * * *